US009022437B2

(12) United States Patent
Ludwig et al.

(10) Patent No.: US 9,022,437 B2
(45) Date of Patent: May 5, 2015

(54) FITTING FOR WINDOWS OR DOORS

(75) Inventors: Manfred Ludwig, Weimar (DE); Reinhold Reitz, Willingshausen (DE); Matthias Klels, Schwalmstadt (DE); Anja Knack, Kirchhein (DE); Markus Tröger, Goldraln-Laisch (DE)

(73) Assignee: Hoppe AG, Stadtallendorf (DE)

( * ) Notice: Subject to any disclaimer, the term of this patent is extended or adjusted under 35 U.S.C. 154(b) by 160 days.

(21) Appl. No.: 13/541,172

(22) Filed: Jul. 3, 2012

(65) Prior Publication Data

US 2013/0009410 A1 Jan. 10, 2013

(30) Foreign Application Priority Data

Jul. 5, 2011 (DE) ..... 10 2011 051 553

(51) Int. Cl.
*E05B 3/00* (2006.01)
*E05B 3/06* (2006.01)
*E05B 15/00* (2006.01)

(52) U.S. Cl.
CPC ..... *E05B 3/06* (2013.01); *E05B 15/0053* (2013.01)

(58) Field of Classification Search
USPC ..... 292/336.3, 347, 348
See application file for complete search history.

(56) References Cited

U.S. PATENT DOCUMENTS 807,194 A * 12/1905 Nichols ..... 451/211
6,601,270 B2 * 8/2003 Eckhardt et al. ..... 16/412
7,686,357 B2 3/2010 Engel et al.

FOREIGN PATENT DOCUMENTS

EP 2107187 4/2009

* cited by examiner

*Primary Examiner* — Mark Williams
(74) *Attorney, Agent, or Firm* — Reinhart Boerner Van Deuren s.c.

(57) ABSTRACT

A window or door fitting for actuation of a mechanism integrated in a window or a door has a stop body that can be attached to the window or the door, a handle, that is rotatably mounted on the stop body in an axially fixed manner, a polygonal element for the mechanical coupling of the fitting to the mechanism integrated in the window of the door, and a coupling configuration formed between the handle and the polygonal element, with which a torque transference from the handle to the polygonal element can be effected, but can be blocked in the direction from the polygonal element to the handle. The coupling configuration has two driving elements for this, wherein a first diving element is connected to the handle in a rotationally locked manner, while a second driving element accommodates the polygon in a rotationally fixed manner.

20 Claims, 7 Drawing Sheets

FITTING FOR WINDOWS OR DOORS

CROSS-REFERENCE TO RELATED APPLICATION

This patent application claims the benefit of German Patent Application No. 102011051553.4, filed on Jul. 5, 2011, entitled "Beschlag fur Fenster oder Turen," which is assigned to the assignee of the present invention and which is hereby incorporated herein by reference in its entirety.

BACKGROUND OF THE INVENTION

Field of the Invention

The present invention relates to a fitting for windows or doors, more particularly to a fitting configured to actuate a mechanism of one of a window and a door.

A fitting such as that known from EP 1 121 501 B1 has a stop body, which can be attached to a window or a door, and a handle in the form of a grip, which can be rotated in an axially fixed manner, mounted on the stop body. A polygonal, preferably square, spindle passes through the stop body, and actuates a closing mechanism integrated in the door.

SUMMARY

A coupling configuration is provided between the handle and the square spindle. This has two driving elements, which can be coupled to one another by means of blocking elements such that a torque acting on the handle can be transferred to the square spindle. A torque acting on the square spindle, in turn, blocks, however, any rotation of the driving elements within the stop body, and thereby an actuation of the closing mechanism integrated in the window or door, such that attempts at forced entry via this means are effectively prevented.

A first driving element of the coupling configuration is connected to the handle in a rotationally fixed manner, while a second driving element accommodates the square spindle in a rotationally fixed manner. The blocking elements located between the driving elements can be displaced by means of functional surfaces or flanks formed on the driving elements, such that in actuating the square spindle, a frictional, form, and/or force-locking traction is generated, which prevents any further rotation within the stop body.

In order to lock the handle in place in the course of orderly operation of the fitting in the ideal angular position, locking pins are provided, disposed in or on recesses or locking indentations in an edge border of the stop body. The locking pins lie in the same plane as the blocking elements and are spring-loaded radially outwards by a pressure spring.

EP 2 107 187 A1 uses a coupling configuration. For the locking of a handle in the ideal functional position, catches are provided, however, formed within the stop body on spring bars. These latter are arranged symmetrically on both sides of a recess in the stop body, which serves to accommodate the first driving element of the coupling configuration, connected in a rotationally fixed manner to the handle. This handle driving element has a flange section, in the periphery of which, separated for example, at 90° intervals, four locking recesses for the catches are incorporated. The handle driving element acts, accordingly, as a retaining socket.

The disadvantage therein is that the stop body is made of plastic, and the driving element is made of metal, in particular, a Zamak alloy. As a result, relatively large frictional forces occur between the stop body and the driving elements, in particular in the region of the flange section, which has an unfavorable effect on the durability of the fitting. The wear to the stop body, and the catch formed on the spring bars, is extreme, having a negative effect on the overall function of the fitting and its reliability.

An aim therefore, is to overcome the disadvantages of the prior art and to create a fitting which is constructed in a cost-effective manner using simple means, and through reduced wear, exhibits a significantly greater durability and reliability.

The characteristics of the invention are given in the characterizing section of claim 1. Additional elements are included in the claims 2-15.

With a fitting for a window or door for the actuation of a mechanism integrated in a window or a door, having a stop body which can be fastened to the window or door, having a handle, which is mounted on the stop body such that it is rotatable in an axially-fixed manner, having a polygonal element for the mechanical coupling of the fitting to the mechanism integrated in the window or door, and having a coupling configuration formed between the handle and the polygonal element, which, however can be blocked from the polygonal element to the handle, wherein the coupling configuration has two driving elements, wherein a first driving element is connected to the handle in a rotationally fixed manner, and wherein a second driving element accommodates the polygonal element in a rotationally fixed manner, and with catch, with which the first driving element in at least one ideal functional position of the handle and/or the mechanism integrated in the door or window, can be locked in position, embodiments of the invention intend that the first driving element is formed in two parts, wherein the first part is connected to the handle, and wherein the second part is supported on the first part of the driving element, and is provided with locking indentations for the catch.

As a result, it is possible to produce the catch and the second part of the driving element, which exhibits the associated locking indentations, from the same material, from a plastic, by way of example, while the first part of the driving element is still produced from a Zamak alloy or another metal. By constructing the second part of the driving element out of a plastic material, significantly improved sliding characteristics within the stop body and in relation to the catch are obtained. In this manner, the individual catch elements can slide over the second part of the driving element with significantly less friction, and as a result, with significantly less wear, engage in its locking recesses. Even after long-term use, a good and reliable locking is ensured, having a favorable effect on the handling and the stability of the fitting. Furthermore, the second part of the driving element serves as a sliding element within the stop body, such that in this region as well, the wear is reduced and the long-term durability is increased. The second part of the driving element can be quickly and simply pre-assembled on the first part, having a favorable effect on the production costs. Furthermore, the materials of both the stop body and the handle, as well as the parts of the driving elements can be better attuned to one another, having the particular advantage, if, with respect to the purpose, the locking and the durability must fulfill technical requirements and/or regulations and limits.

This is the particularly the case when the first and second parts of the driving element are made of different materials, preferably metal and/or plastic.

Moreover, it is structurally favorable when the second part is connected to the first part in a rotationally fixed manner. As a result, both parts always form a solid unit, which can be installed as a pre-assembled assembly within the fitting.

In order that the handle always reliably and precisely achieves the functional position predetermined by the window or the door, the catches are formed on the stop body. Upon achieving the at least one ideal functional position they engage in the locking indentations in the second part of the first driving element. The catches are preferably integrated in the stop body, as a result of which, the construction and assembly are further simplified.

It may be furthermore advantageous if the blocking elements and the catches are disposed in different planes along the rotational axis of the handle, or the polygon, respectively. The catch and the blocking elements can be formed thereby differently and independently of one another, having a favorable effect on the production costs.

It may be advantageous for the function of the coupling configuration, that the driving elements can be coupled to one another in a force and/or form locking manner subject to a predetermined tolerance in the angle of rotation between the surfaces of the driving elements, such that a motion occurring as a result of the actuation of the handle can be transferred to the polygonal element via the driving elements of the coupling configuration located in a rotational manner in the stop body, while a torque acting on the polygon, or the square spindle, respectively, results in the immediate locking of the driving elements within the stop body, as a result of which, a rotational motion of the polygonal element in relation to the stop body and thereby an actuation of the mechanism integrated in the window or door is blocked.

In order to prevent an unauthorized actuation of the handle, or the window or door mechanism, respectively, from outside, via the polygonal element, the coupling configuration exhibits a blocking element present between the driving elements and the stop body, which is constructed and/or disposed such that a torque acting on the handle can be transferred to the polygon, but a torque acting on the polygonal element stops or blocks, however, a movement of the polygonal element, or an actuation of the mechanism integrated in the window or door, respectively. For this, a frictional, form, and/or force locking traction can be generated between each blocking element, on one hand, and the second driving element and the stop body, on the other hand, whereby each blocking element can be displaced and/or actuated by means of functional surfaces or flanks formed on the driving elements.

Another embodiment of the invention provides that each blocking element is spring-loaded and in the form of a cylindrical body or a sphere, wherein blocking recesses corresponding to the blocking elements are provided within the stop body.

With a coupling configuration of this type, the fitting acts as a mechanical diode, i.e. an actuation of the window or door mechanism by means of the handle is possible at any time, while an unauthorized adjustment motion to the polygonal element directly is prevented by the blocking elements, because said blocking elements are pressed into the blocking recesses in the stop body in a force, form, or frictionally locked manner when the second driving element, rigidly connected to the polygonal element in a non-rotatable manner, is rotated. The rotational tolerance provided between the driving elements is important for this. It ensures that with a turning of the handle, the blocking elements are leveraged out of the blocking recesses in the stop body by the functional surfaces or flanks of the first driving element, which is rigidly connected to the handle in a non-rotatable manner, and the driving element surfaces of the driving elements become engaged, before the functional surfaces or flanks of the second driving element, rigidly connected to the polygonal element in a non-rotatable manner, can press the blocking elements into the blocking recesses. In doing so, the catch on the stop body, together with the locking indentations in the first driving element provide for reliable locking positions, particularly when the handle has attained a functional position. Conversely, it is ensured that with an actuation of the polygonal element and the second driving element, connected thereby in a rotationally fixed manner, the blocking elements are pushed into the blocking recesses, before the first driving element can leverage them out.

The entire fitting offers thereby, in a simple manner, a high degree of security. Additional locking cylinders or other locking components are not necessary. The friction between the stop body and the first driving element, coupled in a rotational manner to the handle, is significantly reduced due to the construction of the second part of the driving element from a plastic, in particular, from the same material as that of the stop body, which ensures an optimized handling and a high degree of operational reliability of the fitting.

Each blocking element is dedicated to preferably at least two corresponding blocking recesses within the stop body, such that the blocking effect of the coupling configuration can be effected, if desired, in different settings of the handle. For this purpose, the blocking recesses are therefore disposed at uniform angular intervals in the stop body.

For this, it is structurally convenient if the blocking recesses are formed in a plug body, which is inserted in a force and/or form locking manner in the stop body. Moreover, the plug body accommodates the coupling configuration in the manner of a housing. In addition, it preferably has a recess in which the driving element is mounted in a rotational manner, such that it is concentric to the rotational axis of the handle. In this manner, the plug body forms not only a pivot bearing for the driving element and a counter bearing for the blocking elements. It also secures the driving elements and the blocking elements, and thereby the entire coupling configuration in the stop body, such that a simpler and more compact construction is obtained, per se, which can be quickly and cost-effectively produced and readily operated.

In another embodiment of the fitting according to the invention, it is provided that the length of the section of the polygonal element extending from the stop body and which can be inserted in the window or door frame can be adjusted when the stop body is installed on the window or door automatically, whereby the polygonal element is inserted in the coupling configuration such that it can be displaced longitudinally, and is rotationally fixed, and extends through said coupling configuration and into the handle.

The polygonal element inserted into the coupling configuration such that it can be displaced longitudinally, and is rotationally fixed, automatically adapts thereby to the respective frame or profile thickness of the window or door during the installation of the fitting, without the need for polygonal spindles of different lengths, which have been accordingly selected and implemented thereby. The handling of the fitting is significantly simplified thereby. The stockpiling of numerous different lengths of square spindles in no longer necessary. Moreover, it is ensured that the polygonal element always engages in the mechanism of the window or door, such that the window or the door can be reliably actuated. The operational security is significantly increased. Errors in the installation, in particular, those caused by the installer on-site, are effectively prevented. At the same time, the coupling configuration formed between the handle and the polygonal element provides protection against unauthorized access from outside, as their functionality remains entirely intact.

DESCRIPTION OF THE DRAWINGS

Further characteristics, details and advantages of embodiments of the invention arise from the wording of the claims as well as the following description of embodiment examples based on the drawings. They show:

DETAILED DESCRIPTION OF THE EXEMPLARY EMBODIMENT

Figure 1:
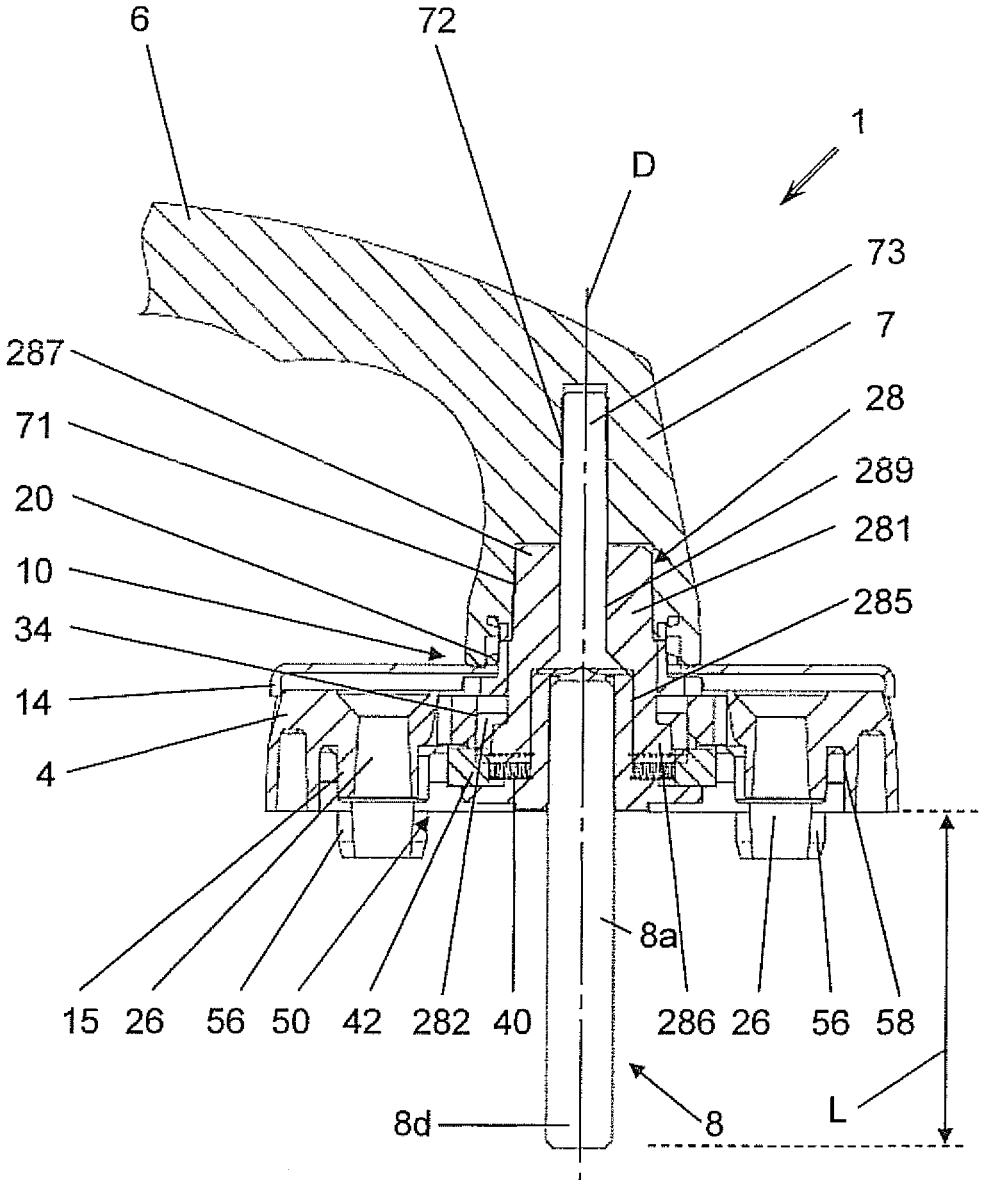
FIG. 1 is a sectional view of an embodiment of a window fitting in accordance with the invention.

The fitting, having the general reference no. 1, depicted in FIG. 1 is constructed as a window fitting. It has a handle 6, which is mounted with a neck 7 to a stop body 4 such that it can rotate in an axially-fixed manner. A polygonal element 8 is provided for the actuation of a mechanism (not shown) integrated in the window, which is preferably in the form of a square spindle. This extends outward from the stop body 4 with a polygonal section 8*a*, in order to engage in a form-locked manner with its free end 8*d* in the window mechanism, in particular in the geared socket (also not shown) provided therein. A coupling configuration 10 formed between the handle 6 and the polygonal element 8 is constructed such that a transference of torque from the handle 6 to the polygonal element can be effected, but which can be blocked from the polygonal element 8 to the handle 6. In this manner, an unauthorized opening of the window by means of actuating the polygonal element or the window mechanism is effectively prevented.

The stop body 4 is constructed as a rosette, which is fastened to a window casement (not shown) by means of fastener screws (not shown). A pivotal cover 14 disposed between the neck 7 and the rosette body 4 can be raised against a pressure spring 20 opposite the undersurface of the neck of the handle. In the installed state of the fitting 1, it covers the rosette body 4, and the fastening screws on the surface. For the rotational mounting of the cover 14, a cylindrical neck section 22 is shaped on the rosette body 4, centrally located over a hole 24 (see FIGS. 2 and 3), which engages with a limited motion tolerance in a centrally located recess 13 of the cover 14. The pressure spring 20, preferably made of plastic, encompasses the neck section 22 and holds the cover 14, which can be locked down at the edges with the rosette body 4, in position.

Two screw holes 26 are incorporated, symmetrically in relation to both sides of the hole 24, in the rosette body 4, for accommodating the fastener screws, which end in cones 15 at the rear. These extend into a central recess 21, which is incorporated at the rear of the rosette body 4, and serves to provide a force and form locking accommodation of a plug body 50.

The plug body 50 has two notches 58 on its edge, coaxial to the screw holes 26 and the cones 15 of the rosette body 4, which accommodate the cones 15 of the rosette body 4 in a form locking manner. A hole 51 in the plug body 50 is located concentrically to the central hole 24 of the rosette body 4 and is thereby also coaxial in relation to the rotational axis D of the handle 6. The hole 51 expands within the plug body 50 to a substantially circular recess 151, which is provided in its circumference with numerous radial indentations 52. The recess 151 serves to accommodate the coupling configuration 10 formed between the handle 6 and the square 8, in particular as a pivot bearing for the two driving elements 28, 42 of the coupling configuration 10. The indentations 52 are symmetrically disposed at both sides of the hole 51, at equidistant angular spacings.

Cones 56 formed at the rear of the plug body 50 extend the screw holes 26 in the rosette body 4 for the fastening screws, and align the rosette body 4 during installation of the fitting 1 on the window frame, which is provided with corresponding holes.

One sees in FIG. 1 that the plug body 50 forms a lower closure for the rosette body 4. Accordingly, the plug body 50 aligns with its lower surface, aside from the cones 56, flush with the lower surface of the rosette body 4. For the positioning of the plug body 50, there are locking projections (not shown) provided within the recess 21 of the rosette body 4, which engage behind corresponding locking edges (also not shown) on the plug body 50 in a force and/or form-locking manner. Not visible disassembly recesses at the edge of the recesses 21 are for the application of a tool, in order to be able to remove the plug body 50, if desired, from the rosette body 4.

Figure 2:
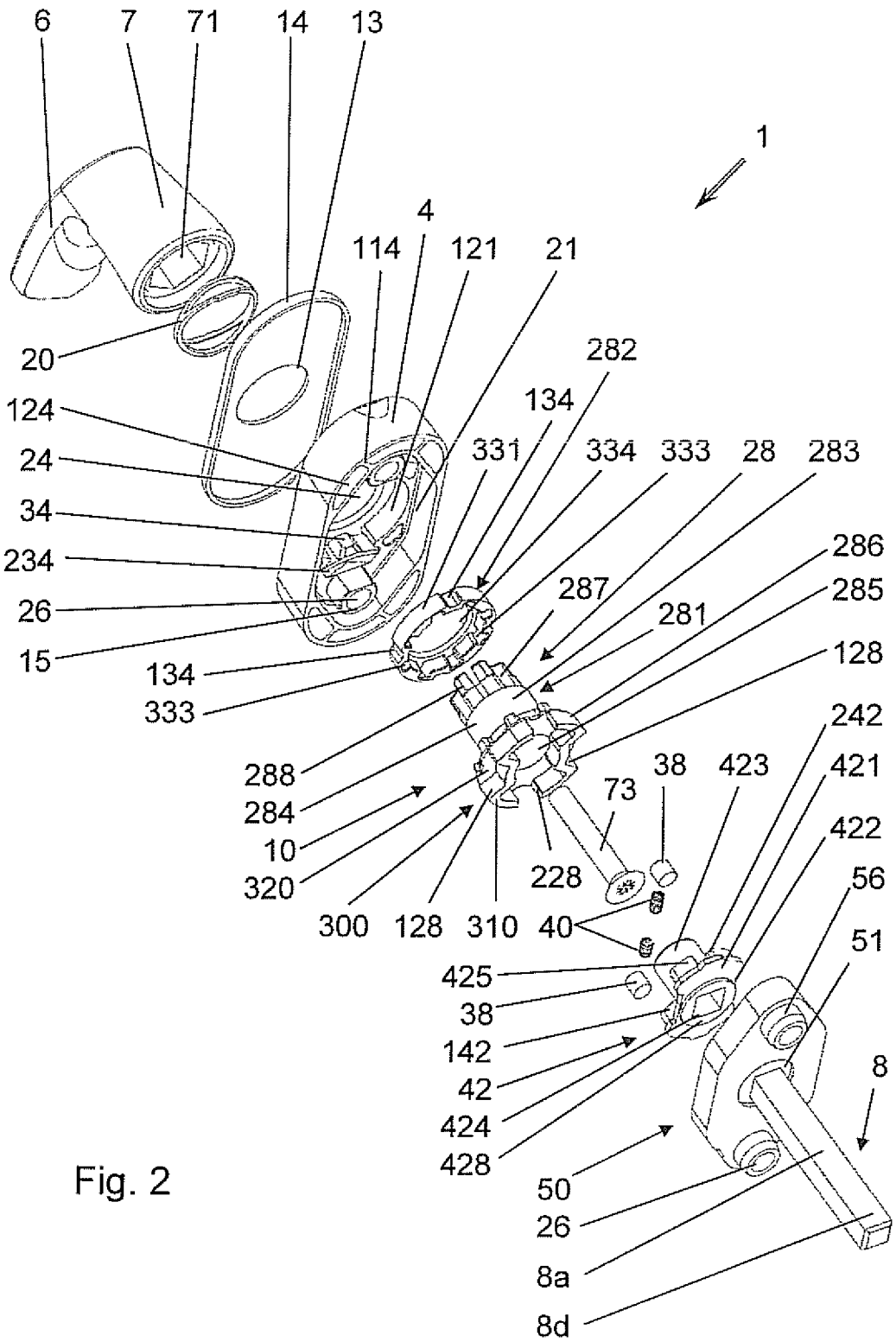
FIG. 2 is an exploded diagram of the fitting shown in FIG. 1 from a first perspective.

As shown in FIG. 2, moreover, holes 124 are provided at the edges, between bridges 114, in the rosette body 4, which is preferably made of plastic. These result in a ribbed structure of the rosette body 4, thus saving on material, and at the same time, having a stiffening effect.

The coupling configuration 10 formed between the handle 6 and the square spindle 8 ensures an increased security against break-ins, because said coupling configuration is created such that the window, or the mechanism integrated therein, respectively can only be actuated from inside, by means of the handle 6, and not from outside, via the square spindle 8. In addition, the coupling configuration 10 has two driving elements 28, 42, whereby a first driving element 28 is connected to the handle 6 such that it is axially and rotationally fixed, while a second driving element 42 accommodates the polygonal element 8 in a rotationally fixed manner. Blocking elements 38 are disposed between the driving elements 28, 42 and the rosette body 4. Together with the driving elements 28, 42, acting as coupling elements, these blocking elements produce a torque acting on the handle 6 that can be transferred to the polygonal element 8, but a torque acting on the polygonal element 8 immediately stops or blocks a motion of the polygonal element, or an actuation of the mechanism integrated in the window or door, respectively.

Figure 4:
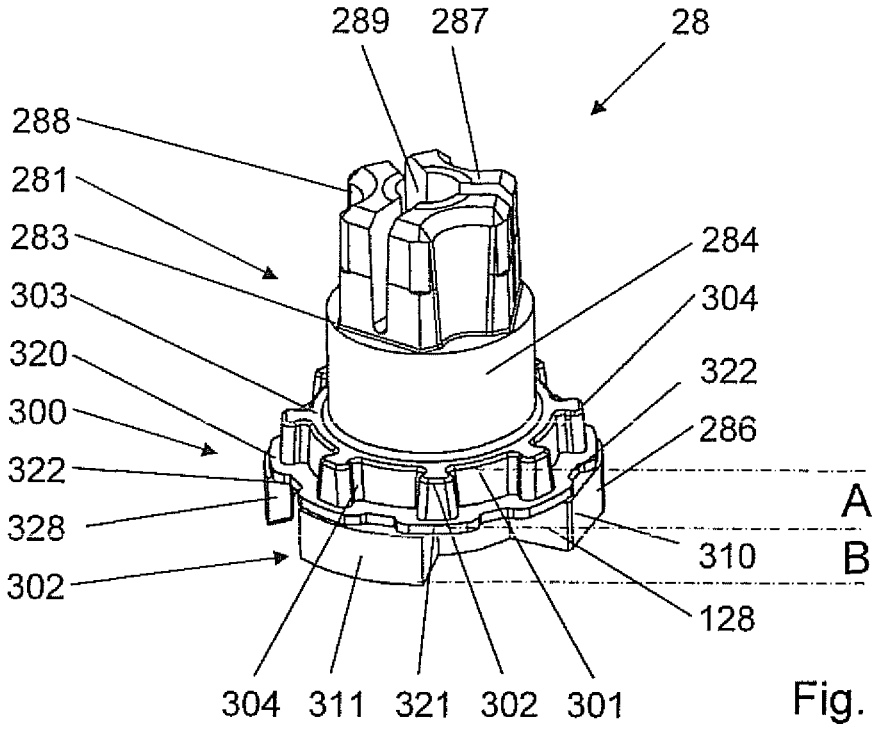
FIG. 4 is an angled view of the first part of the handle driving element.
Figure 5:
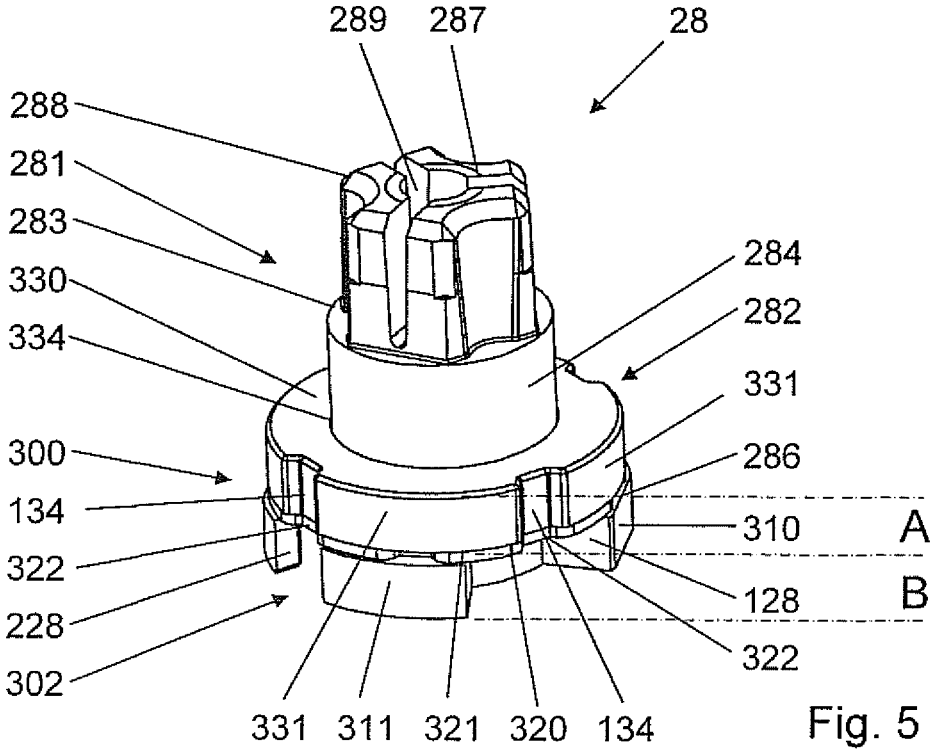
FIG. 5 is the handle driving element of FIG. 4 with the second part placed thereon.
Figure 6:
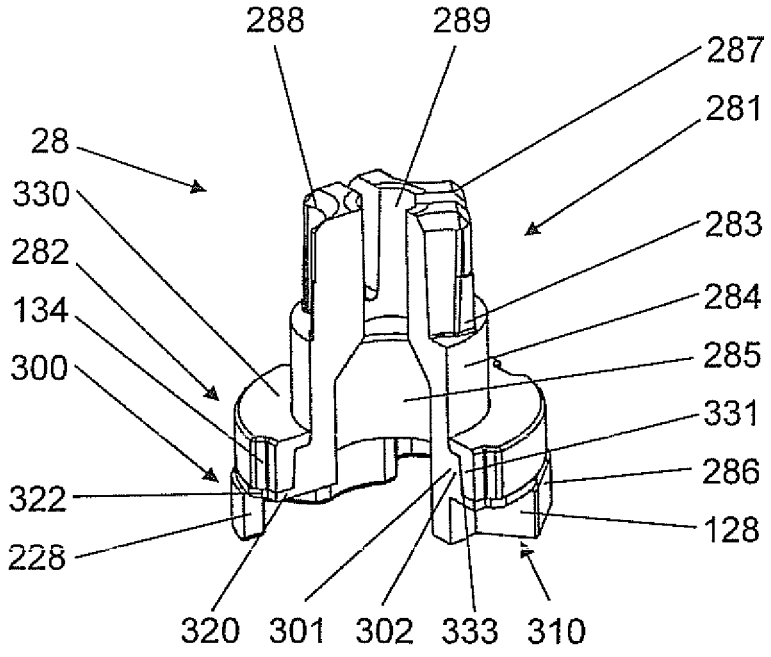
FIG. 6 is a perspective angled view of the handle driving element having a first part and a second part placed thereon, cut-away in part.
Figure 7:
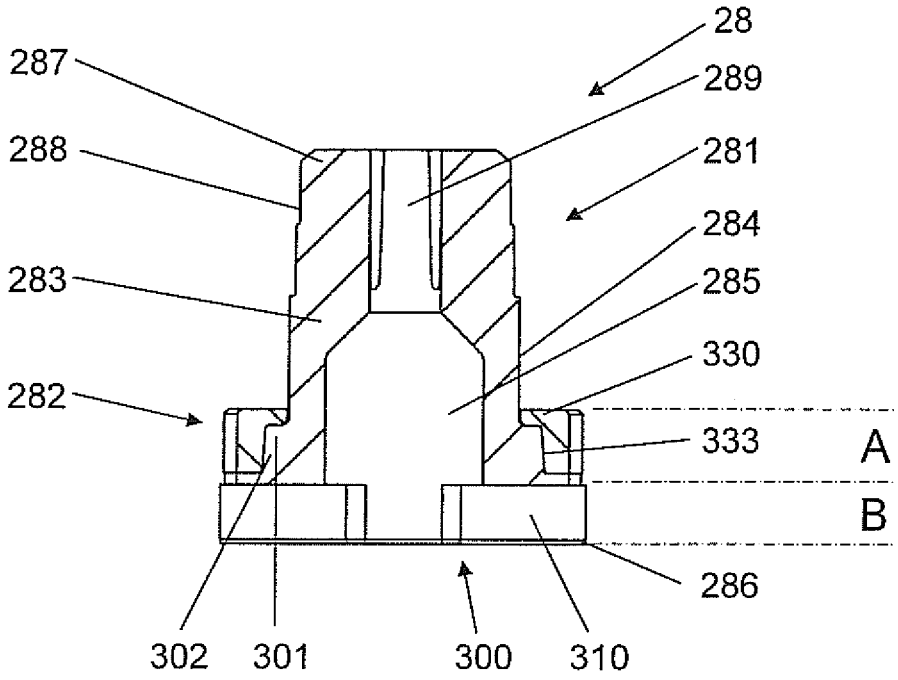
FIG. 7 is a sectional depiction of the handle driving element in FIGS. 4 and 5.

The first driving element 28 forms—as shown in greater detail in FIGS. 4 through 6—a two-part handle driving element. This has a first part 281, which is axially connected in a rotationally fixed manner to the handle 6, while a second part 282 forms a ring, which is placed over the first part 281 of the handle driving element.

The first part 281 of the handle driving element 28 is substantially cylindrical in shape, having a shaft 283, which has a smooth circumferential surface in the middle and a central receptor 285 for the second driving element 42. At its lower end 286, the shaft has a flange collar 300, while the opposite, upper end 287 has a polygonal outer contour 288, which is accommodated in a form locking manner by the neck 7 of the handle 6. This is provided with a corresponding recess 71 having the same shape, which continues axially as a threaded hole 72 for accommodating a screw 73 (see FIG. 1). The first part 281 of the handle driving element 28 is affixed in the handle 6, wherein the upper end 287 of the shaft 283 is provided with a central hole 289 in the region of the polygonal outer contour 288, which accommodates and guides the screw 73. The screw 73 is preferably a countersunk screw. It affixes the first part 281 of the handle driving element 28 in the neck 7 of the handle 6. In order to ensure a durable tight fit of the handle driving element 28 in the handle 6, the shaft 283 has slots in the region of the polygonal outer contour 288, such that the first part 281 of the handle driving element 28 is additionally clamped within the recess 71 in the neck 7 of the handle. The latter can also be slightly conical or stepped in form.

Figure 3:
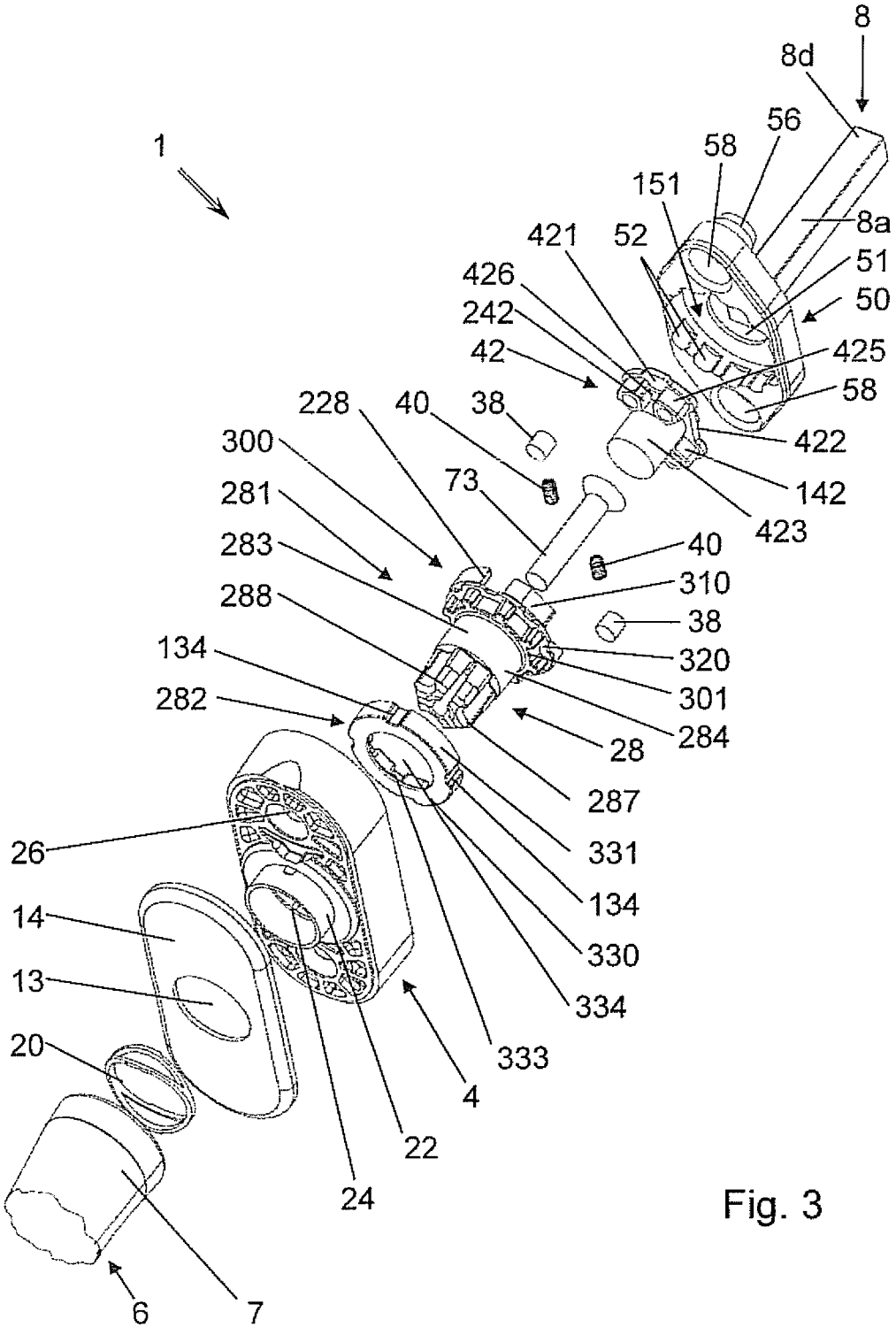
FIG. 3 is an exploded diagram of the fitting shown in FIG. 1 from a second perspective.

As the FIGS. 1-3 also show, the first part 281 of the handle driving element 28 passes through the hole 24 in the stop body 4, wherein the dimensions of the shaft 283 are selected such that said part is rotationally mounted at its circumference 284 in the neck section 22 of the stop body 4 with as little play as possible, while the upper end 287 can be set with the outer contour 288 in the recess 71 of the neck 7 of the handle, and the flange collar 300 lies concentrically within the recess 21 of the stop body 4. The recess 21 is also expanded towards the handle 6 with circular recess 121 for the flange collar 300, wherein the recess 121 also lies coaxially in relation to the rotational axis D. The recess 121 accommodates, in particular, as shall be explained in greater detail later, the second part 282 placed on the first part 281 of the handle driving element 28 in a rotational manner.

The flange collar 300 of the shaft 283 has two substantially overlapping planes, or regions, respectively, A, and B (see FIGS. 3-6 regarding this).

In the first region A, facing the upper end 287, or the handle 6, respectively, there is an annular attachment 301, having an outer circumference that is greater than the outer circumference of the shaft 283. Projections 302 directed radially outwards at equidistant angular spacings are formed on the outer circumference of the annular attachment 301, which form a planar surface 303 together with the annular attachment 301. Each projection 302 has a slightly conical surface and lateral flanks. Moreover, the projections 302 may be provided at both sides proximate to the annular attachment 301 with indentations 304.

In the second region B, the flange collar 300 has two somewhat W-shaped axial projections 310 (see FIG. 2), which engage as coupling elements in the second driving element 42 of the coupling configuration 10. They are disposed symmetrically to the rotational axis D, wherein, there is one projection 310 lying to the right and to the left, respectively, of the rotational axis D. The W-shaped cross-section provides thereby a high degree of stability and durability.

The projections 310 of the flange collar lie within the recess 151 of the plug body when in the assembled state. The outer surfaces 311 of the projections 310 are substantially cylindrical in shape for this reason, wherein the outer diameter of the projections 310, aside from a small degree of play, correspond to the inner diameter of the recess 151 in the plug body 50. As a result, the handle driving element 28 is precisely guided and rotationally mounted in both the neck section 22 of the body of the rosette 4, as well as the recess 151 in the plug body 50, lying congruent thereto.

As FIGS. 2-7 further show, the projections 310 have functional surfaces 128, 228 about their circumference. The surfaces 128 of the projections 310 form driving element surfaces, which engage in the corresponding driving surfaces 142 of the second driving element 42, subject to a predetermined rotational play. The surfaces 228 lying between the W-shaped projections 310, however, form functional surfaces or flanks, which act together with the blocking elements 28 of the coupling configuration 10.

A small lip 320 is formed in the transition from the first region A to the second region B of the flange section 300. The outer diameter of this is greater than the outer diameter of the radial projections 302 of the annular attachment 301, and the same as the outer diameter of the outer surfaces 311 of the projections 310. The disc shaped lip 320 has a circumferential surface 321, in which, at regular spacings, recesses 322 are incorporated. These latter are preferably applied at angular spacings of 45° in the circumferential surface 321, whereby one recess is located symmetrically between the functional surfaces 128, or 228, at every 90° interval.

The second part 282 of the handle driving element 28 is formed by a substantially flat annular disc 330, provided with a central recess 334, and a circumferential edge 331 at the periphery. In this manner, the second part 282 is somewhat annular and has an L-shaped cross-section, which has a favorable effect on its stability.

At the inner circumference of the circumferential edge 331, indentations 333 have been formed, which accommodate, in a form locking manner, the first part 281 of the handle driving element 28. The indentations 333 are therefore also slightly conical in shape, such that the second part 282 is automatically aligned when placed on the first part 181, and is consistently retained without any play. As FIGS. 5 and 6 show more precisely, the circumferential edge 331 of the second element 282 also has a stop on the lip 320, such that the driving element parts 281, 282 will always be precisely joined in an automated production. In addition, or alternatively, the second part 282 of the handle driving element 28 can also lie on the planar surface 303 of the annular attachment 301 or the lip 302.

There are a total of four locking recesses 134 for catch 34, created at angular spacings of 90° in the outer circumference of the circumferential edge 331, wherein the indentations 333 in the inner circumference of the circumferential edge 331 are oriented such that the locking recesses 134 are always congruent to four recesses 322 disposed at 90° from one another respectively, in the circumferential edge 321 of the disc shaped lip 320 of the handle driving element 28. The recesses 322 in the lip 320 supplement thereby the locking recesses 134 in the axial direction.

The catch 34, which engages in the locking recesses 134, are—as shown in FIG. 2—formed in the rosette body 4 on spring bars 234, lying symmetrically in relation to both sides of the recess 121 for the flange section 282. The window handle 6 can be locked in four ideal functional positions by the two catches 34, preferably constructed as a single unit, together with the spring bars 234 and the rosette body 4, preferably in the closed position, the open position (right or left) and the leaning position of the window, whereby in each functional position, both catches 34 engage simultaneously in two locking recesses 134, disposed opposite one another.

The handle driving element 28 of the coupling configuration 10 acts, therefore, not only as a coupling element, but also as a retaining socket. The functional positions are readily recognizable to a user as a result. Operating errors of the window are effectively prevented. Other locking positions are possible, in that further locking recesses 134 are made in the flange section 282, for example at angular spacings of 45°. In this case as well, the two catches 34 engage in two opposing locking recesses 134 in the first driving element 28 when an ideal functional position has been reached, which positions the handle accordingly.

While the flange collar 300 is mounted and guided at its second (lower) region B, specifically the projections 310 in the recess 151 of the plug body 50, the second part 282 of the handle driving element lies in the first region A, and therefore within the recess 121 in the stop body 4. The outer diameter of the circumferential edge 331 of the second part 282 corresponds thereby to the inner diameter of the hole, leaving a small amount of motion tolerance, such that the handle driving element 28 is rotationally mounted here as well.

If one places the annular second part 282 of the handle driving element 28 on the shaft 283 of the first part 281, then the projections 302 of the annular attachment 301 first engage in the indentations 333 in the inner circumference of the circumferential edge 331, until said annular attachment rests at its lower edge (not indicated in detail) on the lip 320 and/or the surface 303 of the first part 281. The inner circumference of the circumferential edge 331 can, thereby, be provided with (not shown) points, which engage in the indentations 304 of the radial projections 302 on the annular attachment 301.

In order that the fitting 10 itself is able to withstand greater loads and frictional forces over longer periods of time, the handle driving element 28 is made of different materials, which is not a problem, due to the two-part construction. Preferably, the first part 281 consists, cost-effectively, of a metal, preferably a Zamak alloy, while the second annular part 282 is made of a plastic. As a result, the second part 282 of the handle driving element 28 within the recess 121 of the rosette body 4 exhibits significantly fewer indications of wear, because this is significantly more resistant both within the recess 121 itself, as well as in relation to the catch 34. At the same time, the annular second part 282 slides with its annular disc 330 and the circumferential edge 331 much more readily within the recess 121, such that the handle 6 can be operated precisely and reliably on a sustained basis.

As is shown by the embodiment, the second part 282 of the handle driving element 28 is always connected in a rotationally fixed manner to the first part 281, while the catches 34 are formed as an integral part of the stop body 4. One can also connect the second part 282 of the handle driving element 28 to the first part 281 in an axially fixed manner, by means of grouting or gluing, for example.

The second driving element 42 forms a polygonal driving element, i.e. it accommodates the square spindle 8 in an rotationally fixed manner. It has a disc shaped base plate 421, which has two lateral cutouts 422 for purposes of reducing the amount of material required. At the center, the base plate 421 has a neck section 423, provided concentrically to the rotational axis D with a square hole 424 for the form-locking, and thereby rotationally fixed, accommodation of the polygonal element 8.

The base plate 421 also has four projections 425 at the edges, which engage as coupling elements with the handle driving element 28 of the coupling configuration 10, in particular with the projections 310 of the flange collar 300. They are disposed symmetrically to the rotational axis D, wherein two projections 425 lie to the right and left, respectively of the longitudinal axis of the rosette body 4. Moreover, they have a trapezoidal cross-section, providing for a high degree of stability and durability.

The (not shown in greater detail) outer surface of the projections 425 is, as a whole, cylindrical, corresponding to the base plate 421, wherein the outer diameter of the base plate 241 and the projections, except for a limited amount of motion tolerance, corresponds to the inner diameter of the recess 151 in the plug body 50. As a result, the polygonal driving element 42, together with the projections 310 of the flange collar 300 at the handle driving elements 42, are guided precisely into the recess 151 of the plug body 50, and rotationally mounted therein, while the second part 282 of the handle driving element 28 is guided on a separate plane A in the form of the plastic ring having an L-shaped cross-section within the recess 121 of the rosette body 4.

In a manner similar to that of the projections 310 of the handle driving element 28, the projections 425 of the polygonal driving element 42 also have functional surfaces 142, 242. The functional surfaces 142 are—like the driving element surfaces 128 of the projections 310—facing away from the longitudinal axis of the rosette body 4. As a result, they also form driving element surfaces, which come into engagement with the driving element surfaces 128 of the handle driving element 28, with a given angular tolerance. The functional surfaces 242, in contrast, face towards the longitudinal axis of the rosette body 4. They act—in a manner similar to that of the functional surfaces 228 of the projections 310—together with the blocking elements 38 of the coupling configuration 10. The surfaces, or flanks, respectively, 228, 242, each lie at an acute angle to the longitudinal axis of the stop body 4 and form therefore a type of V-shaped funnel.

The blocking elements 38 are preferably formed as cylindrical bodies, the axes of which lie parallel to the rotational axis D of the handle 6. They are disposed directly over the base plate 421 at both sides of the neck section 423, between the projections 425, forming receptacles 426. A spring is placed in each of these receptacles 426, which rests at the rear against the neck section 423 in the direction of the rotational axis D, pushing the respective blocking element 38 radially outwards with the other end.

The outer diameters of the blocking elements 38 correspond to the inner diameter of the segmented indentations 52 in the outer circumference of the recess 151 in the plug body 50, wherein the segment depth is less than the radius of the cylinder body 38. In this manner, although they engage in a form-locking manner in the indentations 52, they always lie at their center points within the outer diameter of the recess 151 in the plug body 50.

The blocking elements 38 can also be spherical, or comprise other types of roller bodies, which engage in a form-locking manner in corresponding indentations 52 in the plug body 50.

On the surface of the base plate 421 of the polygonal driving element 42 facing away from the projections 425 there is a cylindrical rise 428 which extends the square recess 424 in the neck section 423 and engages in a form-locking manner in the hole 51 of the plug body 50. In this manner, the driving element 42 is provided with an additional pivot bearing, which has a favorable effect on the stability of the coupling configuration 10.

If one attempts to rotate the polygonal element 8 and thereby the polygonal driving element 42, the blocking elements 38—before the angular tolerance between the handle driving element 28 and the polygonal driving element 42 has been overcome—are pushed by the diagonally lying functional surfaces 242 of the projections 425 of the polygonal driving element 42 radially outwards into the indentations 52 in the plug body 50. The motion of the polygonal element 8 is immediately stopped as a result, in that a form and force-locking is created between the stop body 4, the blocking elements 38 and the polygonal driving element 42. In doing so, each blocking element 38 is moved outwards by means of the functional surfaces 242 formed on the polygonal driving element 42, such that the blocking elements 38 are unable to exit the indentations 52.

Each blocking element 38 has two dedicated, opposing, blocking indentations 52 in each blocking position, such that the coupling configuration 10 can withstand higher loads as well, without difficulty. By means of the indentations 52, disposed at equidistant angular spacings in the plug body 50, it is ensured that the fitting 1 is secured against unauthorized access from outside, even if the handle 6 is not precisely in its ideal functional position, for example, if the handle 6 has not fully reached its closing position at the 6 o'clock location.

Another advantage of the fitting according to the invention is that the driving elements 28, 42 of the coupling configuration can be produced in a manner that saves in the use of material, and thereby are more cost-effective, due to their relative simple geometry. This applies in particular to the handle driving element 28, the parts of which, 281 and 282 in addition can be adapted to the specific loads within the stop body 4 and the plug body 50, in that the first part 281 is made of metal, and the second part 282 is made of a plastic.

The installment of the handle driving element 28 is relatively simple thereby, because the two parts 281, 282, need only be joined together. A gluing, welding or soldering is not necessary, but possible if desired. Likewise, there is no need for an interlocking connection, because the parts 281, 282 of the handle driving element 28 are axially secured within the stop body 4 and the plug body 50 when the fitting 10 is in its installed position. The projections 302 of the first part 281 and the recesses of the second part 282 provide thereby a rotationally fixed connection.

The invention is not limited to any one of the previously described embodiments, but rather, can be varied in numerous manners. As such, one can, for example, produce the second part 282 of the handle driving element 28 out of a special metal alloy instead of plastic, or one can provide a coating on the annular disc 330 and/or the circumferential edge 331 that reduces the friction between the catch 34 and the stop body 4, on the one hand, and the handle driving element 28, on the other hand.

The handle driving element 28 forms a preferably preassembled assembly with its two parts 281, 282 made of different materials, which are installed together with the polygonal driving element 42 in the fitting 10. The two-part structure of the handle driving element 28 has the added advantage that the materials of the first part 281 and the second part 282 can be selected independently of one another, i.e. the materials can be adapted to the respective conditions of use and the loads that are to be expected, without difficulty. As a result, there is a greater degree of procedural certainty with respect to the technical requirements for the fitting, in particular in the case where the prescribed technical regulations must be adhered to. The wear to the plastic ring 282 within the stop body 4 is significantly reduced, such that the fitting 1 exhibits a good degree of locking functionality, even after repeated heavy use. In addition, the end surface of the annular disc 320 acts as a sliding surface within the stop body 4, also having a favorable effect on the functionality and the durability of the fitting 1.

Figure 8:
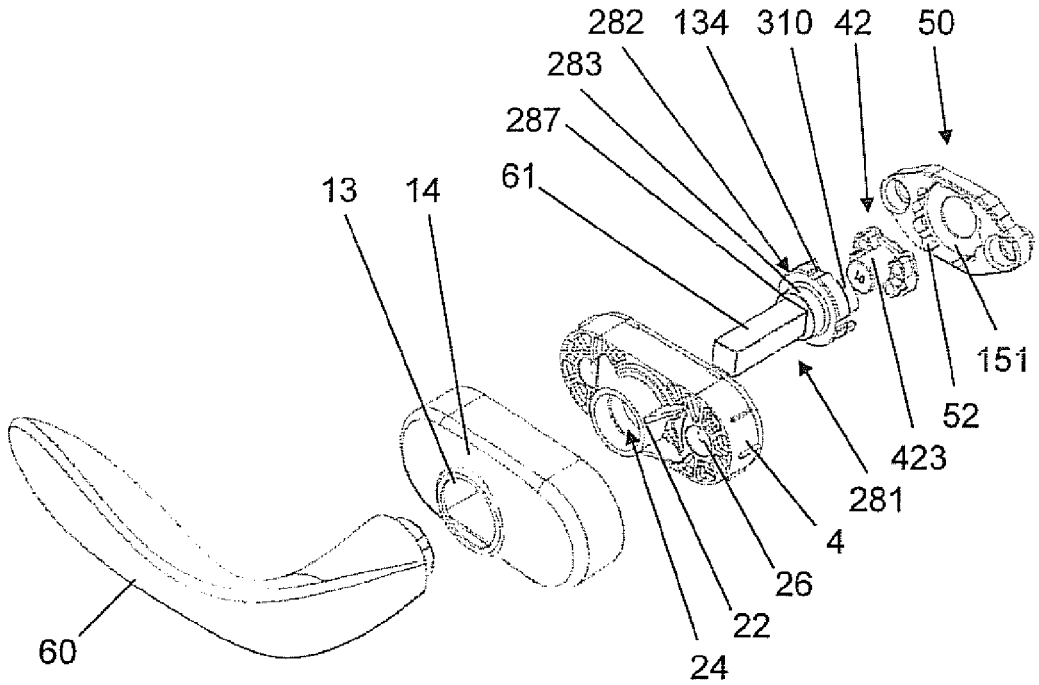
FIG. 8 is an exploded diagram of another embodiment of a window fitting according to the invention.

Another embodiment of the invention provides that the window fitting 1 according to the invention is designed such that a doorknob 60 can be placed on the handle driving element 28. A doorknob normally has no specially shaped recess in the handle neck, but rather a simple square hole, which accommodates the polygonal element in a form-locking manner. Accordingly, the first part 281 of the handle driving element 28 is not provided with a polygonal outer contour 288 at its upper end 287, which is inserted in a recess 71 in the handle neck 7 that has been adapted thereto, but rather, with an extension 61 having a square cross-section, preferably having the shape of a square spindle (see FIG. 8 regarding this). The extension 61 is preferably an integral component of the first part 281 of the handle driving element 28, and extends beyond the neck section 22 of the stop body 4, such that the doorknob 60 can be placed directly onto the extension 61. The design of the second part 282 of the handle driving element 28 remains unchanged, such that reference can be made directly to the above designs.

A substantial advantage of this embodiment is that the handle driving element 28 forms a type of adapter, which enables the window handle rosette 4 to be equipped with a conventional doorknob 60, which is normally provided with a simple square recess in the handle neck. As a result, significant savings can be realized in the warehousing and logistics, because only one type of handle needs to be manufactured. Furthermore, the production costs are also reduced.

The axial attachment of the doorknob 60 to the extension 61 is achieved either by means of a grub screw, or by using a clamping system, such as that disclosed in EP 1 683 933 A2, the contents of which are referenced here in their entirety. The latter has the advantage that no tools are required for the assembly of the doorknob 60 on the stop body 4. The handle is simply placed on the square extension 61 of the handle driving element 28.

Aside from the design as a window fitting, the invention can also be designed as a door fitting on a door.

In another embodiment of the fitting 1 according to the invention, the handle driving element 28 is attached to the handle 6 by means of a riveted or flanged connection.

Figure 9:
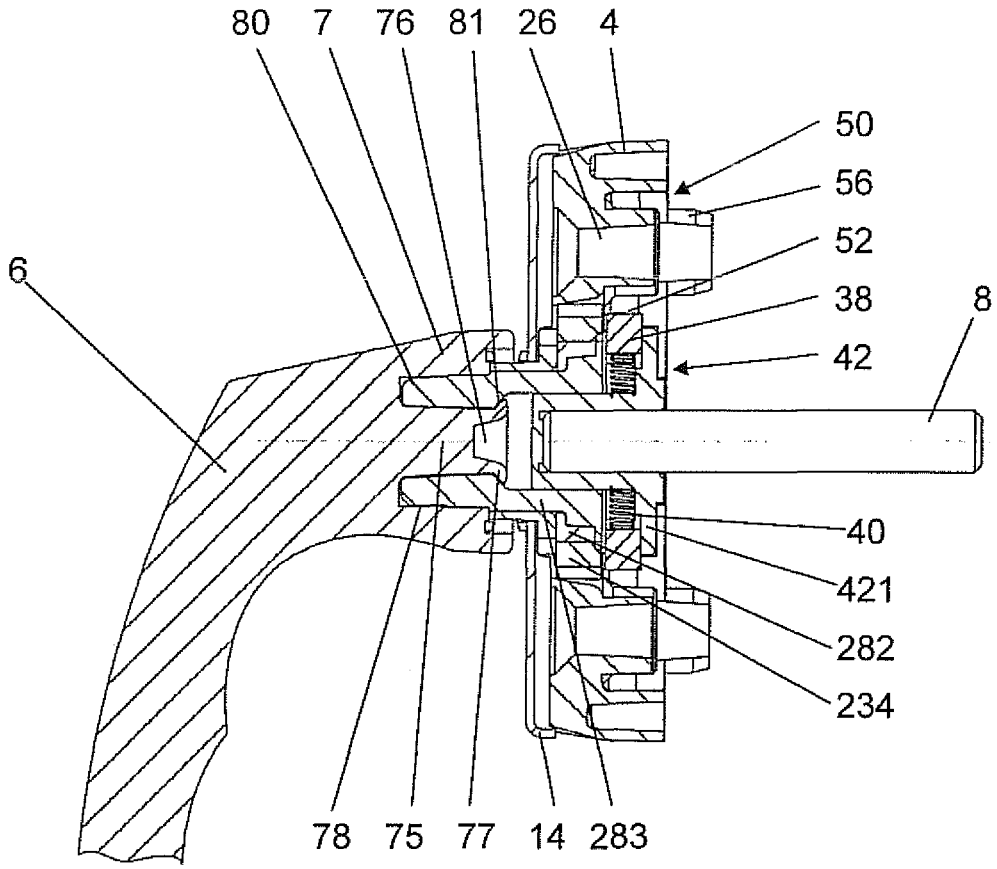
FIG. 9 is a sectional view of another embodiment of a window fitting according to the invention.

The longitudinal section shown in FIG. 9 enables one to see that, in differing from the embodiment in FIG. 1, the screws 73 for fastening the first part 281 of the handle driving element 28 to the handle neck 7 are entirely eliminated. Instead, there is a truncated cone 75 formed in the neck 7, having a recess 76 at the end, such that a circumferential edge is created. The first part 281 of the handle driving element 28 has no polygonal outer contour 288 at its upper end 287, accordingly, but rather a cylindrical neck section 80 which engages in a cylindrical recess 78 between the handle neck 7 and the truncated cone 75.

As is also shown in FIG. 9, the neck section 80 has a step 81 on its inner circumference, wherefore the length of the truncated cone 75 and the length of the neck section 80 are selected such that the circumferential edge 77 of the truncated cone 75 lies in the region of the step 81 of the neck section 80.

In order to attach the handle driving element 28 to the handle 6, the neck section 80 of the first part 281 of the handle driving element 28 is inserted in the recess 78 in the handle neck 7. Subsequently, using an appropriate tool, the circumferential edge 77 of the truncated cone 75 is deformed, radially outwards, and over its entire circumference in the form of a flaring or a flanging, and thereby shaped to the contour of the step 81 of the neck section 80. As a result, a durable, unreleasable form-locking connection between the handle driving element 28 and the handle 6 is created. The deformed circumferential edge 77 takes up the same amount of space thereby as the head of the screw 73 in the embodiment in FIG. 1.

The design of the second part 282 of the handle driving element 28 and the structure and functionality of the coupling configuration 10 are unchanged here, as well, from the previous embodiment examples, such that reference can be made directly to the above embodiments.

One sees that a window or door fitting 1 for actuation of a mechanism integrated in a window or door has a stop body 4, which can be attached to the window or door. Moreover, the fitting 1 has a handle 6, which is mounted on the stop body such that it is rotatable in an axially fixed manner, a polygonal element 8 for the mechanical coupling of the fitting 1 to the mechanism integrated in the window or the door, and a coupling configuration 10 formed between the handle 6 and the polygonal element 8, with which a torque transference from the handle 6 to the polygonal element 8 can be effected, but can be blocked in the direction from the polygonal element 8 to the handle 6. The coupling configuration 10 has two driving elements 28, 42 for this, wherein the first driving element 28 is connected in a rotationally fixed manner to the handle 6, while a second driving element 42 accommodates the polygonal element in a rotationally fixed manner. There are also four catches 34 formed in the stop body 4, with which the first driving element 28 can be locked in position in at least one ideal functional position of the handle 6 and/or the mechanism integrated in the window or door. In order to increase the durability of the fitting 1 and to fulfill further requirements to the fitting 1, the first driving element 28 is designed as being comprised of two parts, wherein the first part 281 is connected to the handle 6 in a rotationally and axially fixed manner, while a second part 282 is placed on the first part 281 and is provided with locking recesses 134 for the catch 34.

All of the characteristics and advantages to be derived from the claims, the description and the drawings, including structural details, spatial configurations and procedural steps can be substantial to the invention, both individually, as well as in different combinations.

LIST OF REFERENCE SYMBOLS

A region
B region
D rotational Axis
L length
1 window or door fitting
4 stop body
6 handle
7 handle neck
71 recess
72 threaded hole
73 screw
75 truncated cone
8 polygonal element
8*a* polygonal section
8*d* free end
10 coupling configuration
13 recess
14 cover
114 bridge
124 hole
15 cone
20 pressure spring
21 recess
121 recess
22 neck section
234 spring bar
24 hole
26 screw hole
28 first driving element (handle)
128 driving element surface
228 functional surface or flank
281 first part
282 second part
283 shaft
284 circumferential surface
285 receptor
286 lower end
287 upper end
288 outer contour
289 hole
300 flange collar
301 annular attachment
302 projection
303 surface
304 indentation
310 projection
311 outer surface
320 lip
321 circumferential surface
322 recess
330 annular disc
331 circumferential edge
333 indentations
334 recesses
34 catch
38 blocking element
134 locking recess
40 spring
42 second driving element (polygon)
421 base plate
422 cutout
423 neck section
424 square recess
425 projection
426 receptacle
428 rise
142 driving element surface
242 functional surface or flank
50 plug body
51 hole
151 recess
52 blocking indentation
56 cone
58 recess
60 doorknob
61 extension
77 circumferential edge
78 recess
80 neck section
81 step

What is claimed is:

1. A fitting for actuating a mechanism integrated in a window or door, the fitting comprising:

a stop body configured to be attached to one of a window and a door;

a handle mounted rotatable about a rotational axis and axially fixed on the stop body;

a polygonal element for a mechanical coupling of the fitting to the mechanism integrated in a window or door;

a coupling configuration formed between the handle and the polygonal element, with which a torque transference can be effected from the handle to the polygonal element, and with which a torque transference can be blocked from the polygonal element to the handle;

wherein the coupling configuration has a first and a second driving elements, wherein the first driving element is connected to the handle in a rotationally fixed manner, and wherein the second driving element is coupled to the polygonal element in a rotationally fixed manner; and a catch with which the first driving element can be locked in at least one position of one of the handle and a mechanism integrated in the window or a door;

wherein the first driving element is a two-part construction comprising a first part and a second part;

wherein the first part is connected to the handle; and wherein the second part is placed on the first part of the first driving element and provided with locking recesses for the catch.

2. The fitting according to claim 1, wherein the first part and the second part of the driving element are made of different materials.

3. The fitting according to claim 1, wherein the second part is coupled in a rotationally fixed manner to the first part.

4. The fitting according to one of the claim 1, wherein the catch is formed on the stop body.

5. The fitting according to one of the claim 1, wherein the catch is an integral part of the stop body.

6. The fitting according to one of the claim 1, wherein the first driving element and the second driving element can be coupled to one another with a predetermined angular tolerance such that a motion occurring as a result of an actuation of the handle can be transferred to the polygon.

7. The fitting according to claim 1, wherein the coupling configuration has at least one blocking element present between the first and second driving elements and the stop body, the blocking element is configured such that a torque acting on the handle can be transferred to the polygonal element, and the blocking element is configured such that a torque acting on the polygonal element blocks one of a movement of the polygonal element and an actuation of a mechanism integrated in a window or door.

8. The fitting according to claim 7, wherein locking traction can be generated for stopping the motion of the polygonal element between the stop body, each blocking element and the second driving element;

wherein each blocking element can be actuated by functional surfaces formed on the first and second driving elements.

9. The fitting according to claim 7, wherein each blocking element is spring-loaded.

10. The fitting according to claim 7, wherein each blocking element is one of a cylindrical body and a sphere.

11. The fitting according to claim 7, wherein blocking recesses corresponding to the blocking elements are provided within the stop body; and wherein each blocking element has at least two dedicated blocking indentations.

12. The fitting according to claim 11, wherein the blocking recesses are formed in a plug body which is placed on the stop body.

13. The fitting according to claim 12, wherein the plug body has a recess in which the first and second driving elements are rotationally mounted in a manner concentric to the rotational axis of the handle.

14. The fitting according to claim 7, wherein the blocking elements and the catch are disposed along the rotational axis of the handle in different planes.

15. The fitting according to claim 1, wherein the polygonal element extends with a polygonal section beyond the stop body;

wherein the length of the polygonal section, extending beyond the stop body is configured for automatic adjustment when the stop body is attached to a window or door; and wherein the polygonal element is guided in the coupling configuration such that it can be displaced longitudinally, is rotationally fixed, and extends through the configuration and into the handle.

16. A fitting comprising:

a first driving element;

a handle coupled to the first driving element such that rotation of the handle about a handle rotation axis causes rotation of the first driving element;

a second driving element;

a spindle coupled to the second driving element such that when the second driving element is rotated it causes rotation of the spindle;

the second driving element and the first driving element defining a receptacle; and a blocking element disposed in the receptacle;

wherein rotation of the handle about the handle rotation axis causes rotation of the spindle;

wherein the first driving element includes a first part and a second part;

wherein the first part is connected to the handle; and wherein the second part is configured to be disposed on the first part of the first driving element and defines locking recesses for a catch.

17. The fitting of claim 16, wherein the second driving element includes a base extending generally perpendicular to the handle rotation axis and being configured to generally deter movement of the blocking element towards the spindle out of the receptacle.

18. The fitting of claim 16, further comprising a body configured to be coupled to at least one of a door or a window, the body including a catch configured to interact with the locking recess of the first driving element such that the first driving element can be locked in at least one position of the handle.

19. The fitting of claim 18, wherein the first driving element includes a first part and a second part;

wherein the first part is connected to the handle; and wherein the second part is configured to be disposed on the first part of the first driving element and defines the locking recesses.

20. The fitting of claim 16 further comprising a plug body defining a circular recess in which the second driving element is rotationally disposed, the plug body including at least one radial recess into which the stop is configured to be disposed when the spindle is rotated.

* * * * *

UNITED STATES PATENT AND TRADEMARK OFFICE

CERTIFICATE OF CORRECTION

PATENT NO. : 9,022,437 B2
APPLICATION NO. : 13/541172
DATED : May 5, 2015
INVENTOR(S) : Manfred Ludwig et al.

It is certified that error appears in the above-identified patent and that said Letters Patent is hereby corrected as shown below:

In the title page:

(75) Inventors:

"Matthias Klels, Schwalmstadt (DE)" should read --Matthias Kleis, Schwalmstadt (DE)--.

Signed and Sealed this
Fifth Day of April, 2016

Michelle K. Lee

Michelle K. Lee
*Director of the United States Patent and Trademark Office*